US005979014A

United States Patent [19]

Reichow et al.

[11] Patent Number: 5,979,014

[45] Date of Patent: Nov. 9, 1999

[54] MOBILE WET/DRY VACUUM DEVICE

[75] Inventors: Steve Reichow, Eden Prairie; Al C. Miller, Plymouth; Keith E. Nygaard, Albertville; Don F. Ketcher, Mound, all of Minn.

[73] Assignee: Nilfisk-Advance, Inc., Plymouth, Minn.

[21] Appl. No.: 08/927,152

[22] Filed: Aug. 29, 1997

[51] Int. Cl.[6] ..... A47L 9/22; A47L 7/00

[52] U.S. Cl. ..... 15/412; 15/320; 15/321; 15/340.1; 15/340.2

[58] Field of Search ..... 15/412, 320, 321, 15/340.1, 340.2

[56] References Cited

U.S. PATENT DOCUMENTS

| | | | |
|---|---|---|---|
| 3,052,908 | 9/1962 | Daneman . | |
| 3,797,600 | 3/1974 | Miner . | |
| 3,879,789 | 4/1975 | Kasper . | |
| 3,930,630 | 1/1976 | Wulff . | |
| 5,239,720 | 8/1993 | Wood et al. . | |
| 5,363,533 | 11/1994 | Young et al. | 15/340.1 |
| 5,432,975 | 7/1995 | Hilmanowski . | |
| 5,623,743 | 4/1997 | Burgoon et al. | 15/320 |
| 5,657,509 | 8/1997 | Trautloff et al. | 15/321 |

*Primary Examiner*—Krisanne Thornton
*Attorney, Agent, or Firm*—Alan Kamrath; Oppenheimer, Wolff & Donnelly, LLP

[57] ABSTRACT

A wet/dry vacuum device includes a canister unit that is pivotally mounted to an upstanding portion of a support carriage for movement between a lowered, in-use position and a raised, emptying position. Also pivotally attached to the upstanding portion of the support carriage is a lifting assist lever upon which the canister unit rests for movement between the lowered and raised positions. Interposed between the carriage and the lifting assist lever is a device, such as linear acting, fluid spring, for assisting in manually tilting the canister unit. The fluid spring is preferably interconnected to each of the carriage and the lifting assist lever through respective loss motion connections which enable a rather large tilting range for the canister unit while minimizing the required length of the fluid spring. The canister unit is readily removable from the remainder of the wet/dry vacuum device and is provided with a pouring spout extending rearwardly from an upper portion thereof to enhance the draining of the contents of the canister unit upon tilting of the canister unit or upon removal thereof from the carriage.

23 Claims, 2 Drawing Sheets

MOBILE WET/DRY VACUUM DEVICE

BACKGROUND OF THE INVENTION

1. Field of the Invention

The present invention pertains to the art of vacuum cleaning devices and, more particularly, to a wet/dry vacuum cleaning device constructed to enhance the emptying of both solid and liquid debris therefrom.

2. Discussion of the Prior Art

The use of wet/dry vacuum devices for cleaning, both solid and liquid debris from a surface is widely known in the art. In general, such wet/dry vacuum cleaning devices incorporate a canister into which both the solid and liquid debris can be drawn. Some wet/dry vacuum devices are designed to be carted to a floor or other low level drain zone at which a plug provided in the bottom of the canister can be removed to empty the vacuumed solution. However, it is often desirable to empty the contents of a wet/dry canister at a level above the bottom of the canister. For example, it may be desirable to empty the canister into a sink, a drain area having a raised side wall, another canister, a toilet, or the like, wherein draining the contents of the canister from the bottom is not convenient or practical. For this reason, many wet/dry vacuum devices provide for the canister to be tipped in order to pour the solution from the canister. It should be appreciated that the solution in the canister is relatively heavy and therefore considerable force is required to empty the solution from the canister in this fashion.

Based on the above, there exists a need for an improved wet/dry vacuum cleaning device that will enable both solid and liquid debris to be emptied by tipping a canister of the device with a minimal exertion of force on the part of the operator of the device. There also exists a need for a wet/dry vacuum device of this type which exhibits an enhanced support arrangement for the canister.

SUMMARY OF THE INVENTION

The present invention solves these deficiencies and other problems related to emptying a canister of a wet/dry vacuum cleaning device when having to tip and pour the contents of the canister by mounting the canister to a support carriage for movement between a lowered, in-use position and a raised, emptying position, while also incorporating a device that acts between the canister and the support carriage to assist the user in tipping the canister.

In a preferred form of the invention, a lift lever is pivotally mounted to the support carriage and supports the canister. A fluid spring extends between a bracket mounted to the support carriage and the lift lever in order to help the operator tip the canister. In addition, the canister is advantageously provided with a pour spout at an upper end thereof which directs the solid and/or liquid debris away from the support carriage as the canister is emptied. Further, the pivot axis is located adjacent the upper end of the canister to keep the pour spout elevated in the emptying position. Additionally, the support carriage, canister and lift lever are particularly constructed for ease of removal of the canister from atop the lift lever and support carriage when desired.

In the most preferred form of the invention, the fluid spring is interconnected between the support carriage and the lift lever by means of a lost motion connection in order to enable use of a shorter, more compact fluid spring. In addition, the support carriage, which includes a base portion and an upstanding portion having associated therewith a plurality of wheels which enable the wet/dry vacuum device to be easily transported between various locations, is formed with upper ear portions that define open ended cavities which receive lug members of the canister. This provides a direct interconnection between the canister and the support carriage, while also enabling the canister to be detached from the support carriage. Furthermore, the lift lever includes a terminal clip for engaging the canister, with the clip also enabling the canister to be readily removed from the remainder of the device.

It is thus an object of the present invention to provide a wet/dry vacuum cleaning device having an improved arrangement for mounting of a canister upon a support carriage for movement between a lowered, in-use position and a raised, emptying position.

It is another object of the present invention to provide a wet/dry vacuum cleaning device which incorporates a fluid spring or like device provided to help the operator in shifting the canister from the lowered position to the raised position.

It is a further object of the present invention to provide a wet/dry vacuum device that incorporates a pivotally mounted lift lever upon which the canister is supported for movement between the lowered and raised positions.

It is a further object of the invention to interpose the fluid spring directly between the support carriage and the lifting assist lever and to incorporate a lost motion connection for the fluid spring which accommodates a wider range of motion of the canister relative to the support carriage with the use of a relatively short fluid spring.

It is a still further object of the invention to provide a wet/dry vacuum device having a canister unit which is specifically configured to enhance the emptying of its contents upon tilting through a limited angle relative to the support carriage and by being readily removably attached to both the support carriage and a lifting assist lever. In further aspects of the present invention, the canister unit includes a pour spout which is elevated in the emptying position.

Additional features and advantages of the wet/dry vacuum device of the present invention will become more readily apparent from the following detailed description of the preferred embodiment thereof when taken in conjunction with the drawings wherein like reference numerals refer to corresponding parts in the several views.

Figure 1:
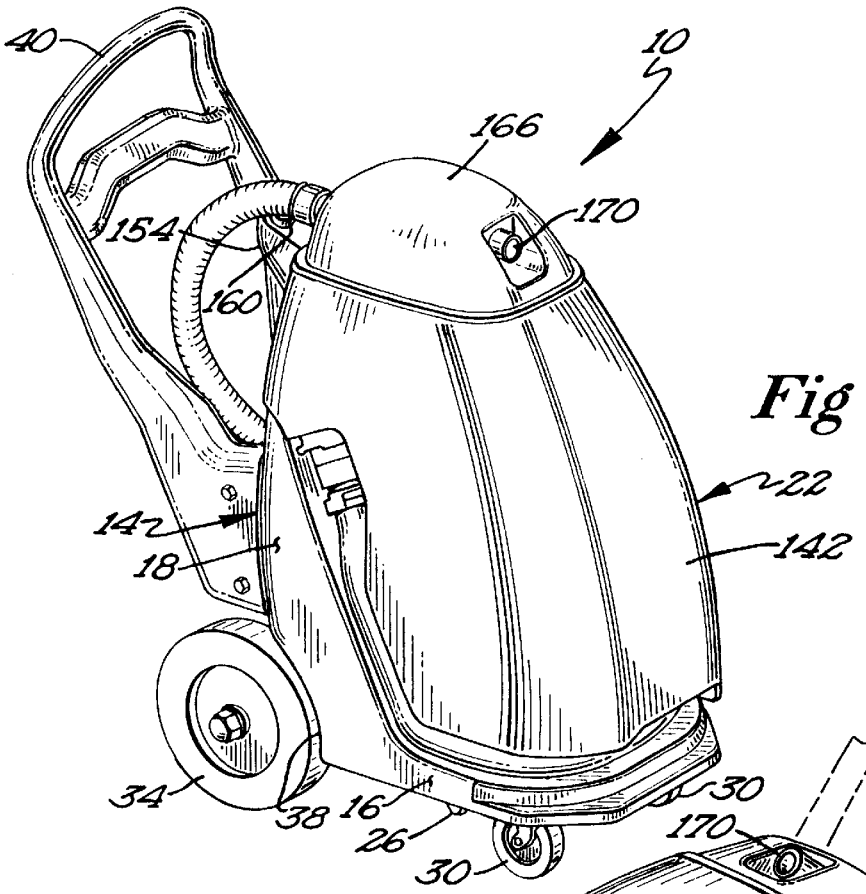
FIG. 1 is a right front perspective view of a wet/dry vacuum device constructed in accordance with the present invention in an in-use position.
Figure 2:
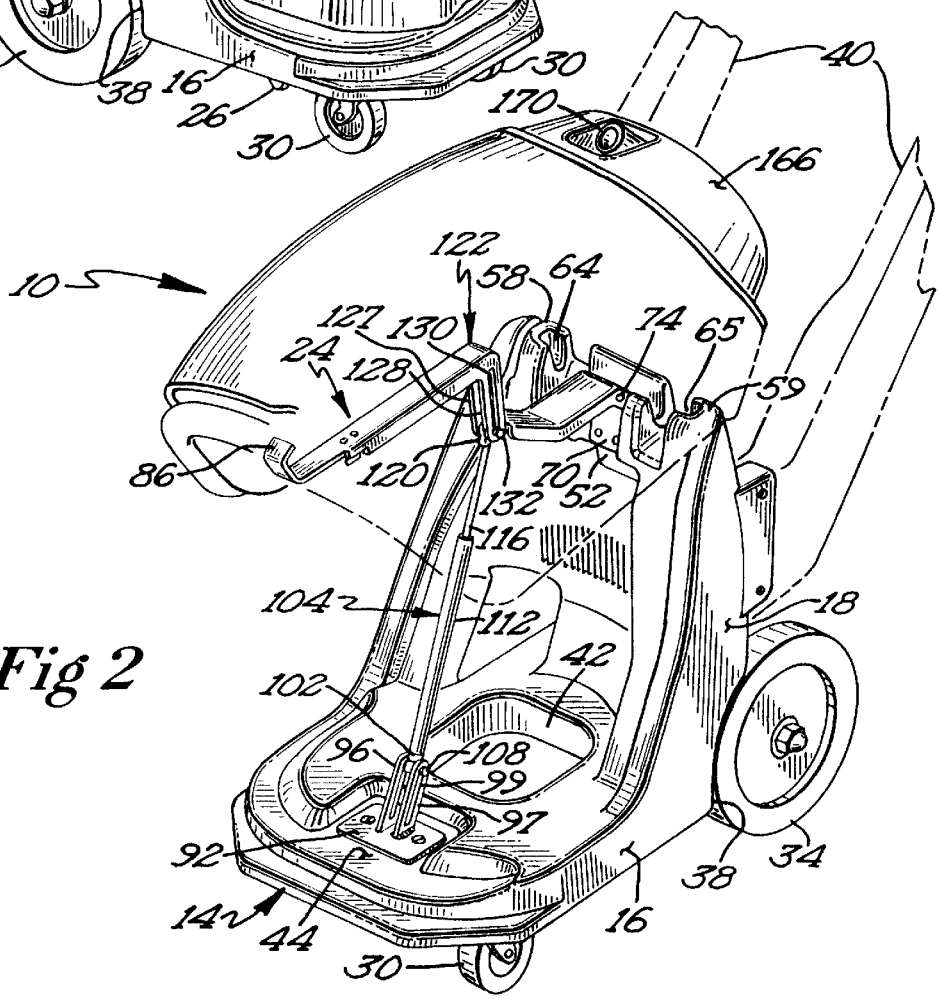
FIG. 2 is a left front perspective view of the wet/dry vacuum device of FIG. 1 in a raised or emptying position.
Figure 3:
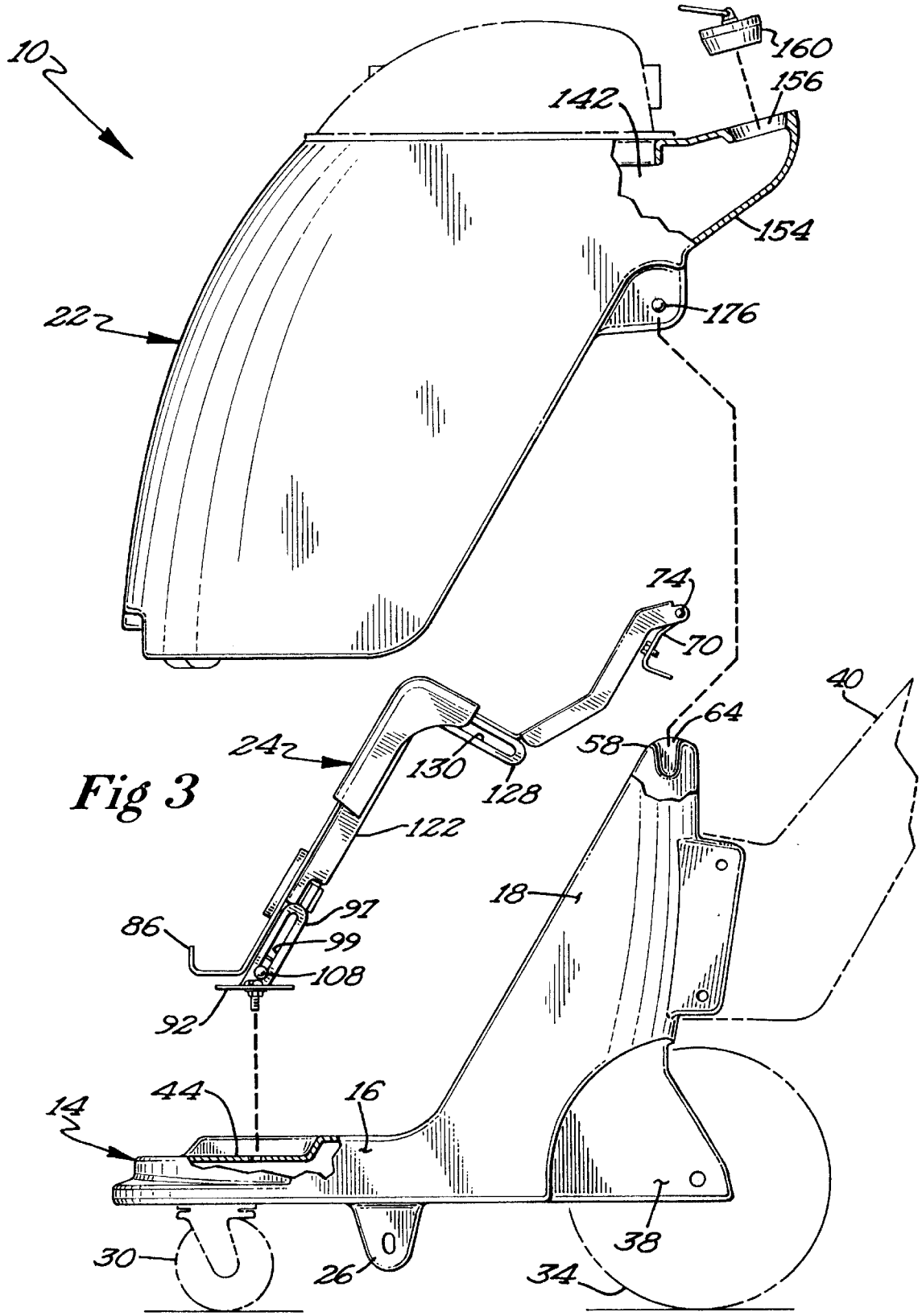
FIG. 3 is a left side elevational and exploded view of the wet/dry vacuum device of the present invention, with portions broken away to reveal additional details.

At this point, it should be noted that all of these figures are drawn for ease of explanation of the basic teachings of the present invention only; the extension of the figures with respect to the number, position, relationship and dimensions of the parts to form the preferred embodiment will be explained or will be within the skill of the art after the following teachings of the present invention have been read and understood. Further, the exact dimensions and dimensional proportions to conform to specific force, weight, strength and similar requirements will likewise be within the skill of the art after the following teachings of the present invention have been read and understood.

Furthermore, when the terms "both", "first", "second", "lower", "upper", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENT

A wet/dry vacuum device according to the preferred teachings of the present invention is shown in the drawings and generally designated 10. Device 10 generally includes a support carriage 14, including a base portion 16 and an upstanding portion 18, a canister unit 22 and a lifting assist lever 24. As shown, base portion 16 can be formed with one or more mounting members 26 for use in attaching an accessory, such as a squeegee (not shown) to device 10. In the preferred form, wet/dry vacuum device 10 is designed for ease of portability and maneuverability upon a supporting surface and therefore caster wheels 30, as well as rear wheels 34, are attached to support carriage 14. In order to provide a compact arrangement and to enhance safety in utilizing device 10, rear wheels 34, which are preferably larger than caster wheels 30, are arranged within arcuate recessed areas 38 formed as part of support carriage 14. In addition, a handle 40 is connected to upstanding portion 18 of support carriage 14 for maneuvering device 10.

In the preferred embodiment, the entire support carriage 14 is molded of plastic, such as through a rotational molding operation. Base portion 16 extends generally horizontally and is provided with a void area 42, to minimize the material utilized and to provide structural strength. Forward of void area 42, base portion 16 is provided with a flattened frontal mounting zone 44. Upstanding portion 18 is actually adapted to house a vacuum motor (not shown) for generating suction during operation of wet/dry vacuum device 10. Upstanding portion 18 extends upwardly and rearwardly, at an angle in the preferred range of approximately 30–45°, from horizontal base portion 16 and is also formed with a centrally located, upper mounting area 52. Upstanding portion 18 actually terminates in a pair of spaced upper ear portions 58 and 59, between which mounting area 52 is located. Ear portions 58 and 59 define slotted cavities 64 and 65 respectively, which are open upwardly and inwardly.

Lifting assist lever 24 is interconnected to an upper mounting plate 70 through a hinge pin 74. Upper mounting plate 70 is fixedly secured to upstanding portion 18 at centrally located, upper mounting area 52 by any means known in the art, such as mechanical fasteners. With this arrangement, lifting assist lever 24 is permitted to pivot relative to support carriage 14 about a generally horizontal axis defined by hinge pin 74. Lifting assist lever 24 also includes a lower clip 86 that is adapted to engage canister unit 22.

Secured to frontal mounting area 44, such as through the use of threaded mechanical fasteners, is a lower mounting plate 92. Mounting plate 92 has extending upwardly and rearwardly therefrom a pair of spaced brackets 96 and 97, each of which is preferably formed with an elongated slot 99. Adapted to be slidably mounted to brackets 96 and 97 is a lower end 102 of a linear acting, fluid spring 104. In the preferred form of the invention, fluid spring 104 constitutes a gas cylinder and, more particularly, a pneumatic linear actuator. However, other types of lifting assist actuators known in the art could also be utilized without departing from the spirit of the invention. As shown, lower end 102 of fluid spring 104 is actually interconnected to brackets 96 and 97 by means of a pin 108 that projects into each slot 99. In the embodiment shown, lower end 102 actually defines part of a cylinder portion 112 of fluid spring 104 and fluid spring 104 also includes an upper, piston rod portion 116 that is adapted to telescope relative to cylinder portion 112. Since the actual construction of fluid spring 104 and the manner in which piston rod portion 116 telescopes relative to cylinder portion 112 is known in the art and is not considered part of the present invention, it will not be further discussed herein. However, it should be noted that piston rod portion 116 includes an upper end 120 which is pivotally mounted to lifting assist lever 24. More specifically, lifting assist lever 24 includes a generally L-shaped bracket portion 122 having a pair of laterally spaced legs 127 and 128. Each of the legs 127 and 128 is formed with a respective elongated slot 130 into which extends a pin 132. Of course, pin 132 also extends through an opening formed in upper end 120 of rod portion 16 in order to pivotally and slidably attach fluid spring 104 to lifting assist lever 24.

Actually, in the preferred form of the invention, lifting assist lever 24 assumes a lowered position wherein slots 99 extend generally parallel to a lower, rearwardly angled portion (not separately labeled) of lifting assist lever 24. Fluid spring 104 also extends generally parallel to slots 99 in this position and assumes a compact condition extending along one section of the L-shaped bracket portion 122 to avoid increasing the required overall size or height of device 10. On the other hand, slots 130 extend generally perpendicular to both slots 99 and fluid spring 104, while upper end 120 is positioned between legs 127 and 128. Although the particular reason for interconnecting fluid spring 104 to support carriage 14 and lifting assist lever 24 in the manner described will be more fully discussed below, at this point, it should be realized that the positioning of pins 108 and 132 within slots 99 and 130 enable relative pivoting and sliding movement between fluid spring 104 and both base portion 16 and lifting assist lever 24.

Canister unit 22 actually defines a debris collecting tank 142 that has associated therewith an upper spout section 154. As clearly shown in these drawings, spout section 154 projects rearward of support carriage 14 and has an upper opening 156 through which the contents of tank 142 can be drained. During use of wet/dry vacuum device 10, a plug 160, a flapper valve, or similar stopper is adapted to seal opening 156. Canister unit 22 also includes an upper cover 166 under which is adapted to mount or house various conventional elements of a wet/dry vacuum, including a filter, hose, hook-ups, etc. Cover 166 has associated therewith an inlet port 170 to which a hose can be attached for directing solid and liquid debris into tank 142.

Canister unit 22 is adapted to be removably attached to both support carriage 14 and lifting assist lever 24. More specifically, canister unit 22 is provided with a pair of laterally spaced, outwardly extending lugs 176 which are adapted to be seated within slotted cavities 64 and 65 of upstanding portion 18 respectively and define a pivot axis for canister unit 22 that is adjacent the generally horizontal axis defined by hinge pin 74. In the preferred form of the invention, each lug 176 has an associated diameter which is generally equal to the width of a respective cavity 64, 65, but has an associated height which is considerably less than its associated cavity 64, 65. With this arrangement, lugs 176 enable canister unit 22 to pivot relative to support carriage 14 between a raised position, wherein tank 142 can be emptied through spout section 154, and a lowered, in-use position, while assuring that canister unit 22 will not have a tendency to raise out of cavities 64 and 65 due to gravity. When canister unit 22 is attached to support carriage 14, a lower surface portion of canister unit 22 also conforms to and rests directly upon lifting assist lever 24. In addition, canister unit 22 is actually interconnected with lifting assist lever 24 by means of lower clip 86. In this manner, lifting assist lever 24 moves commensurate with canister unit 22 between the raised and lowered positions, with hinge pin 74 being located between lugs 176.

At this point, it should be appreciated that tilting of canister unit 22 from the lowered position to the raised position when tank 142 is significantly filled with debris can require considerable force. However, the inclusion of fluid spring 104 substantially reduces the manual force needed to tilt canister unit 22 by the operator. In addition, the particular manner in which fluid spring 104 is interconnected to both support carriage 14 and lifting assist lever 24 minimizes the required length for fluid spring 104, while still providing a rather large angle through which the canister unit 22 can pivot. More specifically, the interconnection of the fluid spring 104 to the slotted brackets 96 and 97, as well as L-shaped bracket portion 122, establishes lost motion connections between these elements. Thus, when the canister unit 22 is in the lowered, upright position and is first lifted, pin 108 provided at the lower end 102 of fluid spring 104 will abut the bottom of slots 99. At the same time, pin 132 is positioned at the uppermost end of slots 130, i.e., the portion of slots 130 farthest from hinge pin 74. As canister unit 22 is being tilted from its upright position to its raised position, piston rod portion 116 will expand relative to cylinder portion 112 to its maximum length while providing the desired level of lift assistance to the operator. At that time, pin 108 provided at the lower end 102 of fluid spring 104 and pin 132 provided at an upper end of fluid spring 104 will be caused to slide within the slots 99 and 103 respectively. Of course, fluid spring 104 does not actually provide further assistance in tilting of canister unit 22 during this lost motion but, at this stage of the tilting, the required force by the operator is considerably less.

Once in the raised position, tank 142 of canister unit 22 is generally horizontal or preferably tilted slightly rearward and spout section 154 projects rearward of upstanding portion 18 of support carriage 14. More specifically, the lower rear portion of canister unit 22, i.e., the rear wall portion of tank 142, when in a lowered position, preferably extends upwardly at an angle commensurate with that of upstanding portion 18 of carriage 14 such that the substantially horizontal top and bottom of canister unit 22 are located forward of the pivot axis for canister unit 22 as defined by lugs 176. At the same time, spout section 154 extends rearward of the pivot axis defined by lugs 170. When in the lowered condition, canister unit 22 assumes a generally vertical condition and rests upon lifting assist lever 24 and, preferably, the bottom and rear portions of canister unit 22 abut adjacent portions of support carriage 14. With this arrangement, the contents of tank 142 can be emptied in a clean and efficient manner. In other words, this configuration advantageously enables the rear portion of the canister unit 22 to reach a generally horizontal position with only an acute angle of tilting relative to support carriage 13, as opposed to if the rear portion of canister unit 22 was either vertical or forwardly angled in a non-tilt position. In addition, it should be noted that spout section 154 is actually angled slightly upwardly when canister unit 22 is in the lowered position. However, only a slight amount of pivoting of canister unit 22 is required in order for spout section 154 to reach a generally horizontal condition. At this time, the contents of tank 142 will flow into spout section 154 and, given the positioning of spout section 154 behind lugs 176, the center of gravity shifts such that the weight of the contents in spout section 154 will actually further assist in the tilting of canister unit 22 and the pouring of the contents therefrom. Particularly due to this arrangement, lifting assist lever 24 and its associated parts can simply be made available as an accessory, if desired, which could be added to the basic components of device 10 by a user.

Given the manner in which canister unit 22 is attached to each of support carriage 14 and lifting assist lever 24, canister unit 22 can also be advantageously, completely removed from the remainder of the wet/dry vacuum device 10. More specifically, canister unit 22 need merely be vertically lifted to become released from lower clip 86 and dislodged from within slotted cavities 64 and 65.

Now that the basic teachings of the wet/dry vacuum device 10 according to the preferred embodiment of the present invention have been set forth, it should be apparent that other variations will be obvious to persons skilled in the art. Thus, the invention disclosed herein may be embodied in other specific forms without departing from the spirit or general characteristics thereof, some of which forms have been indicated, and the embodiment described herein should be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. A mobile wet/dry vacuum device comprising, in combination: a support carriage including a base portion and an upstanding portion; a plurality of wheels mounted to the carriage to aid in maneuvering of the carriage upon a supporting surface; a canister unit pivotally mounted about an axis defined by the upstanding portion of the carriage for movement between a lowered position, in which the canister unit is arranged atop the base portion in a generally vertical condition for collection of both solid and liquid debris into the canister unit, and a raised position, in which the canister unit is tilted relative to the base portion for emptying the canister unit; and means for assisting in manually tilting the canister unit from the lowered position to the raised position, with the assisting means being interposed between the base portion and the canister unit.

2. The wet/dry vacuum device according to claim 1 wherein the assisting means comprises a linear acting, fluid spring.

3. The wet/dry vacuum device according to claim 2, further comprising, in combination: at least one lost motion connection interconnecting the fluid spring to at least one of the base portion and canister unit.

4. The wet/dry vacuum device according to claim 3 wherein the at least one lost motion connection comprises a slotted bracket to which a respective end portion of the fluid spring is slidably and rotatably mounted.

5. The wet/dry vacuum device according to claim 4 wherein the slotted bracket of the at least one lost motion connection extends upwardly from the base portion and is angled towards the upstanding portion of the carriage for guiding the fluid spring during tilting of the canister unit to the raised position.

6. The wet/dry vacuum device according to claim 1 further comprising, in combination: a lifting plate having an upper end pivotally attached to the upstanding portion of the carriage, with the canister unit abutting and being supported upon the lifting plate for concurrent movement between the raised and lowered positions.

7. The wet/dry vacuum device according to claim 6 wherein the assisting means is interconnected between the base portion and the lifting plate.

8. The wet/dry vacuum device according to claim 7 further comprising, in combination: at least one lost motion connection interconnecting the assisting means and at least one of the base portion and the lifting plate.

9. The wet/dry vacuum device according to claim 1 wherein the canister unit is provided with a pouring spout at an upper rear portion thereof, with the pouring spout being located on an opposite side of the axis than the base portion.

10. The wet/dry vacuum device according to claim 9 wherein the pouring spout is angled upwardly and rearwardly when the canister unit is in the lowered position and reaches a substantially horizontal position with only limited tilting of the canister unit.

11. The wet/dry vacuum device according to claim 1 wherein the upstanding portion of the carriage is formed with a pair of laterally spaced ear portions provided with open ended cavities and the canister unit is formed with a pair of lugs which are received within the cavities, with the lugs aiding in defining the axis about which the canister unit pivots relative to the carriage, with the lugs being readily removable from tile cavities for detaching the canister unit from the carriage.

12. The wet/dry vacuum device according to claim 11 further comprising, in combination: a lifting plate having an upper end pivotally attached to the upstanding portion of the carriage, with the canister unit abutting and being supported upon the lifting plate for concurrent movement between the raised and lowered positions, and a fluid spring interconnected between the base portion and the lifting plate.

13. A mobile wet/dry vacuum device comprising, in combination: a support carriage including a base portion and an upstanding portion; a plurality of wheels mounted to the carriage to aid in maneuvering of the carriage upon a supporting surface; and a canister unit pivotally mounted about an axis defined by the upstanding portion of the carriage for movement between a lowered position, in which the canister unit is arranged atop the base portion in a generally vertical condition for collection of both solid and liquid debris into the canister unit, and a raised position, in which the canister unit is tilted relative to the base portion for emptying the canister unit, with the upstanding portion of the carriage being formed with a pair of laterally spaced car portions provided with open ended cavities and the canister unit is formed with a pair of lugs adapted to be received within the cavities and aiding in defining the axis about which the canister unit pivots relative to the carriage, with the lugs being readily removable from the cavities for detaching the canister unit from the carriage.

14. The wet/dry vacuum according to claim 13 further comprising, in combination: a lifting plate having an upper end pivotally attached to the upstanding portion of the carriage, with the canister unit abutting and being supported upon the lifting plate for concurrent movement between the raised and lowered positions, and means for assisting in manually tilting the canister unit from the lowered position to the raised position.

15. The wet/dry vacuum device according to claim 14 further comprising, in combination: first and second lost motion connections, with the first lost motion connection being interposed between the assisting means and the base portion and the second lost motion connection being interposed between the assisting means and the lifting plate.

16. The wet/dry vacuum device according to claim 13 wherein the upstanding portion of the carriage is angled upwardly and rearwardly, and the canister includes a tank portion having a substantially horizontal bottom portion and rear wall portion that also angles upwardly and rearwardly such that the rear wall portion of the tank reaches a generally horizontal position with tilting of the canister unit through an acute angle.

17. The wet/dry vacuum device according to claim 16 wherein the canister unit is provided with a pouring spout at an upper rear portion thereof, with the pouring spout being located on an opposite side of the axis than the base portion.

18. The wet/dry vacuum device according to claim 17 wherein the pouring spout is angled upwardly and rearwardly when the canister unit is in the lowered position and reaches a substantially horizontal position with only limited tilting of the canister unit such that the pouring spout section will become filled with a portion of the contents of the tank upon initial tilting of the canister unit which, in turn, will assist in further tilting of the canister unit.

19. A mobile wet/dry vacuum device comprising, in combination: a support carriage including a base portion and an upstanding portion; a plurality of wheels mounted to the carriage to aid in maneuvering of the carriage upon a supporting surface; and a canister unit pivotally mounted about an axis defined by the upstanding portion of the carriage for movement between a lowered position, in which the canister unit is arranged atop the base portion in a generally vertical condition for collection of both solid and liquid debris into the canister unit, and a raised position, in which the canister unit is tilted relative to the base portion for emptying the canister unit, with the canister unit including a tank positioned forward of the axis about which the canister unit pivots and a pouring spout section that is provided at an upper portion of the canister unit, internally opens into the tank and projects rearward of the axis about which the canister unit pivots, with the tank having a rear wall portion that also angles upwardly and rearwardly such that the rear wall portion of the tank reaches a generally horizontal position with tilting of the canister unit through an acute angle.

20. The wet/dry vacuum device according to claim 19 wherein the pouring spout section is angled upwardly and rearwardly when the canister unit is in the lowered position and reaches a substantially horizontal position with only a limited tilting of the canister unit such that the pouring spout section will become filled with a portion of the contents of the tank upon initial tilting of the canister unit which, in turn, will assist in further tilting of the canister unit.

21. The wet/dry vacuum device according to claim 19 wherein the upstanding portion of the carriage is formed with a pair of laterally spaced ear portions provided with open ended cavities and the canister unit is formed with a pair of lugs which are received within the cavities, with the lugs aiding in defining the axis about which the canister unit pivots relative to the carriage, with the lugs being readily removable from the cavities for detaching the canister unit from the carriage.

22. The wet/dry vacuum device according to claim 19 further comprising, in combination: a lifting plate having an upper end pivotally attached to the upstanding portion of the carriage, with the canister unit abutting and being supported upon the lifting plate for concurrent movement between the raised and lowered positions, and means for assisting in manually tilting the canister unit from the lowered position to the raised position.

23. The wet/dry vacuum device according to claim 19 wherein the upstanding portion of the carriage includes a front section that extends upwardly and rearwardly at an angle to the base portion, with the rear wall portion, of the tank abutting the front section when the canister unit is in the lowered position.

* * * * *

UNITED STATES PATENT AND TRADEMARK OFFICE

CERTIFICATE OF CORRECTION

PATENT NO. : 5,979,014

DATED : November 9, 1999

INVENTOR(S) : Steve Reichow, et al.

It is certified that error appears in the above-identified patent and that said Letters Patent is hereby corrected as shown below:

Col. 5, line 51, cancel "170" and substitute therefor --176--.

Col. 7, line 19, cancel "tile" and substitute therefor --the--.

Col. 7, line 41, cancel "car" and substitute therefor --ear--.

Col. 8, line 62, cancel "portion," (2nd Occurrence) and substitute therefor --portion--.

Signed and Sealed this

Twenty-third Day of May, 2000

*Attest:*

Q. TODD DICKINSON

*Attesting Officer*

*Director of Patents and Trademarks*